US009057566B2

(12) United States Patent
Lesueur et al.

(10) Patent No.: US 9,057,566 B2
(45) Date of Patent: Jun. 16, 2015

(54) SEALING MEANS FOR A HEAT EXCHANGER HEADER BOX

(75) Inventors: Jean-Marc Lesueur, Reims (FR); Christian Riondet, Bourgogne (FR)

(73) Assignee: VALEO SYSTEMES THERMIQUES, Le Mesnil Saint Denis, Cedex (FR)

( * ) Notice: Subject to any disclaimer, the term of this patent is extended or adjusted under 35 U.S.C. 154(b) by 645 days.

(21) Appl. No.: 12/867,580

(22) PCT Filed: Feb. 11, 2009

(86) PCT No.: PCT/EP2009/051557

§ 371 (c)(1), (2), (4) Date: Oct. 7, 2010

(87) PCT Pub. No.: WO2009/101101

PCT Pub. Date: Aug. 20, 2009

(65) Prior Publication Data

US 2011/0017434 A1 Jan. 27, 2011

(30) Foreign Application Priority Data

Feb. 13, 2008 (FR) ..... 08 00759

(51) Int. Cl.

| | |
|---|---|
| ***H02G 3/22*** | (2006.01) |
| ***F16L 17/06*** | (2006.01) |
| ***H02G 15/04*** | (2006.01) |
| ***B21D 39/06*** | (2006.01) |
| ***B21D 53/00*** | (2006.01) |
| ***B23P 15/26*** | (2006.01) |

(Continued)

(52) U.S. Cl.

CPC ..... *F28F 9/0226* (2013.01)

(58) Field of Classification Search

USPC ..... 165/81, 83, 173, 149; 29/890.043; 277/606, 609, 616

See application file for complete search history.

(56) References Cited

U.S. PATENT DOCUMENTS

| | | | | |
|---|---|---|---|---|
| RE31,889 | E * | 5/1985 | Nonnenmann et al. | 165/173 |
| 6,296,051 | B1 * | 10/2001 | Sahnoun et al. | 165/173 |
| 6,988,544 | B2 | 1/2006 | Ozaki et al. | |

(Continued)

FOREIGN PATENT DOCUMENTS

| | | | |
|---|---|---|---|
| DE | 4243495 | A1 | 6/1994 |
| DE | 10360472 | A1 | 7/2004 |

(Continued)

OTHER PUBLICATIONS

FR2031668A5 claims translation.*

(Continued)

*Primary Examiner* — Allen Flanigan
*Assistant Examiner* — Jon T Schermerhorn
(74) *Attorney, Agent, or Firm* — Howard & Howard Attorneys PLLC

(57) ABSTRACT

The invention relates to a header tank for a heat exchanger, comprising a header plate intended for the fixing of a plurality of tubes through which at least one fluid flows, and a cover intended to close the header tank at least in part when fixed to the header plate, and an elastic sealing means (1) situated between the header plate and the cover, characterized in that the sealing means (1) is arranged resting against and in tension on at least two ends of tube. The invention also relates to the heat exchanger that incorporates two header tanks like those defined and to the method of fitting such a sealing gasket in a header tank.

7 Claims, 5 Drawing Sheets

(51) Int. Cl.
*A61C 5/06* (2006.01)
*F28F 9/02* (2006.01)

(56) References Cited

U.S. PATENT DOCUMENTS

| | | | | |
|---|---|---|---|---|
| 7,156,401 | B2 | 1/2007 | Merklein et al. | |
| 7,779,893 | B2 * | 8/2010 | Leitch et al. | 165/70 |
| 2002/0162648 | A1 | 11/2002 | Crook | |
| 2007/0169926 | A1 * | 7/2007 | Watanabe et al. | 165/183 |

FOREIGN PATENT DOCUMENTS

| | | | |
|---|---|---|---|
| EP | 1462754 | A2 | 9/2004 |
| FR | 2031668 | A5 | 11/1970 |
| FR | 2031668 | A5 * | 11/1970 |
| FR | 2093349 | A5 | 1/1972 |
| FR | 2867553 | A1 | 9/2005 |
| GB | 1353928 | A | 5/1974 |
| WO | WO 2005066568 | A1 | 7/2005 |
| WO | WO 2006004071 | A1 | 1/2006 |
| WO | WO 2009101138 | A1 | 8/2009 |

OTHER PUBLICATIONS

FR2031668A5 description translation.*

FR2031668A5 Nov. 1970 claims translation.*

FR2031668A5 Nov. 1970 description translation.*

English language abstract for DE 4243495 extracted from espacenet.com database dated Dec. 21, 2010, 7 pages.

English language abstract for DE 10360472 extracted from espacenet.com database dated Jan. 7, 2011, 14 pages.

French patent FR 2031668 extracted from espacenet.com database Dec. 21, 2010, 12 pages, No English Available.

English language equivalent for FR 2093349 extracted from espacenet.com database Dec. 21, 2010, 12 pages.

English language abstract for FR 2867553 extracted from espacenet.com database Dec. 21, 2010, 14 pages.

PCT International Search Report for PCT/EP2009/051557, dated Apr. 24, 2009, 4 pages.

PCT International Search Report for PCT/EP2009/051642, dated APr. 20, 2009, 5 pages.

* cited by examiner

SEALING MEANS FOR A HEAT EXCHANGER HEADER BOX

RELATED APPLICATIONS

This application claims priority to and all the advantages of International Patent Application No. PCT/EP2009/051557, filed on Feb. 11, 2009, which claims priority to French Patent Application No. FR 08/00759, Filed on Feb. 13, 2008.

The invention relates to the field of heat exchangers, particularly for motor vehicles.

The invention relates more specifically to a header tank or box mounted on a brazed heat exchanger, that is to say a heat exchanger the various elements of which are fixed together definitively by a brazing operation (by applying a layer of braze material and passing it through a dedicated brazing oven).

Motor vehicle heat exchangers such as radiators and supercharger exchangers, use header tanks that form an inlet or outlet chamber, made of one or more pieces. Conventionally, these header tanks consist of at least two pieces, one of these two pieces forming the header plate and the other forming the cover intended to be fixed to the header plate in order to close the header tank at least in part.

Header tanks are generally of two types, namely of the "all-metal" type or of the type provided with a plastic cover. The "all-metal" type of header tank has a certain number of advantages over the type of header tank that has a plastic cover which requires the fixing of a sealing means, conventionally an elastic sealing gasket, in order to ensure a perfectly fluid-tight connection between the cover and the header plate.

The header plate has a groove or channel in which the sealing gasket is intended to be positioned and fitted. Next, the cover is positioned on the sealing gasket and then, conventionally, the header plate is crimped, for example using teeth situated at the periphery of the header plate.

Moreover, for obvious space-saving and sizing reasons, some header tank header plates have no groove or channel to facilitate the positioning and retention of the sealing gasket.

The main problem lies in positioning the sealing gasket on the header plate, prior to the fitting of the cover, because this operation of positioning the sealing gasket is the main root cause of production difficulties.

There may be several reasons for this poor positioning of the sealing gasket.

The sealing gasket may exhibit a manufacturing defect that causes it to warp, and this intrinsic defect in the gasket is not readily identifiable because of the dimensions of the sealing gasket, or even because of its color. Moreover, if the sealing gasket is too long, there will be puckering along its profile as the cover is fixed down. This leads to somewhat unsatisfactory sealing and to fluid leaks in the more or less long term.

Positioning the sealing gasket is generally a manual operation performed by an operator because it is difficult to use a machine, the main problem with the automatic positioning of the sealing gasket lying in the ability of the machine to pick up or grasp the sealing gasket from a plurality of sealing gaskets stored in a bin or the like. Moreover, sealing gaskets are conventionally made of rubber and therefore carry the risk of easily being damaged.

In order to solve these problems, documents DE 4243495, U.S. Pat. No. 7,156,401 and FR 2867553 all disclose methods and/or means intended to tension the sealing gasket, but implementation of these solutions presents a certain number of disadvantages.

In document DE 4243495, the sealing gasket comprises protrusions situated at the four corners around which the gasket can be stretched, these protrusions then being positioned in dedicated slots in the header plate. One major disadvantage with this solution lies in the need to create slots at the various corners of the header plate, something which represents an additional manufacturing cost and weakens the header plate, particularly reducing its ability to withstand cyclic pressures. Moreover, because the protrusions of the gasket protrude beyond the header tank (also known as "collector"), they increase the size of the header tank (packaging).

Document U.S. Pat. No. 7,156,401 discloses a solution very similar to the solution in document DE 4243495 and therefore has the same disadvantages as the latter.

Document FR 2867553 discloses a solution in which pegs are produced on the cover at the corners, the purpose of these pegs being to hold the sealing gasket in shape and possibly to tension it. This solution only with difficulty allows the sealing gasket to be positioned correctly along the length of the cover because it can easily fall off while the cover is being handled up to the point at which it is fitted onto the header plate.

It is an object of the present invention to remedy the disadvantages of the header tanks of the prior art by proposing a solution for simply and securely fixing a sealing gasket to a header plate and for subsequent perfect fixing of the cover onto the header plate. One advantage of the invention is that it allows satisfactory positioning of the gasket even when the header plate has no groove.

Thus, the invention consists in a header tank for a heat exchanger, comprising:

- at least one part known as a "header plate", having at least one series of orifices, which series is arranged in a direction of extension of the plate, said orifices being provided for the passage of a plurality of tubes or the like through which at least one fluid flows, said header plate being intended for the fixing of said plurality of tubes, and
- at least one part known as a "cover" intended to close said header tank at least in part when fixed to said header plate, and
- an elastic sealing means situated between the header plate and the cover, characterized in that the sealing means can be arranged resting against and in tension on at least one part that emerges into said tank of the tubes that pass through the orifices located at the opposite ends of said singular or plural series of orifices.

The benefit of the invention essentially lies in the particularly reliable positioning of the sealing means on the header plate, the sealing means being arranged resting against and in tension on at least the ends, which emerge into the tank, of the tubes that are located on each side of the core, avoiding any loss of this gasket and any possibility of incorrect positioning (by twisting, turning, warping or the like) of the sealing means on the header plate and with respect to the cover (or base of the cover), without thereby requiring any additional device or any complex operation.

The expression "end of a tube" or "tube end" means either just the extreme end part of the tubes that protrudes, from the header plate, into the header tank (or the header tank space), or also the flanges that generally exhibit a protrusion with respect to the header plate. Thus, the tube end may relate to the tube(s) and/or the flange(s).

Other advantageous aspects of the invention are listed below:

- the elastic sealing means comprises gripping means for the tensioning of said sealing means;
- the header plate extends along a substantially planar surface so that the sealing means is not (necessarily) positioned in a dedicated indentation or groove;

the region situated between the gripping means constitutes the elastic region of the sealing means, it being possible for the other regions of said means to be elastic or inelastic;

the gripping means consist of at least two portions extending substantially perpendicular to the plane of extension of the sealing means and connecting two opposite edges of said means;

the support via which the sealing means rests against the ends of the tubes is situated at a different height than the plane of extension of said sealing gasket;

the aforementioned support for resting against the ends of the tubes is higher up than or above the plane of extension of the sealing gasket or in the same plane;

the support against which the sealing gasket rests is solely or only on the ends of the tubes.

The invention also relates to a heat exchanger comprising a heat exchange core consisting of a plurality of tubes or the like the ends of which are respectively fixed by brazing to two header tanks, as described hereinabove, in which exchanger the gasket is arranged resting against and in tension on at least that part that emerges into said tank of the tubes that pass through the orifices located at the opposite ends of said singular or plural series of orifices.

The invention also relates to a method for fitting an elastic sealing means in a header tank as described hereinabove, comprising the following successive steps:

a) gripping at least two gripping means, b) elongating (or stretching out) an elastic region at least situated between the two gripping means, c) fitting the sealing means against at least two ends of tube situated on the periphery of the header plate.

Advantageously, steps a), b), c) are performed automatically using a machine, or manually by an operator.

In the description that follows, which is given solely by way of example, reference is made to the attached drawings in which.

Figure 1:
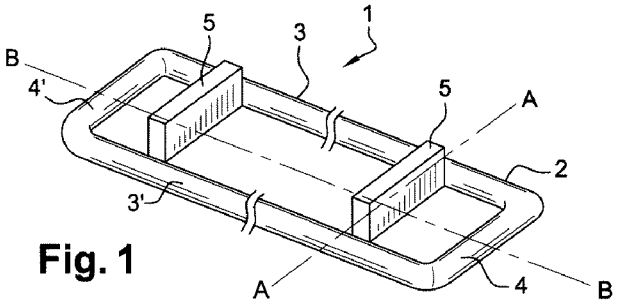
FIG. 1 is a schematic perspective view of a first embodiment of a sealing means according to the invention.
Figure 10:
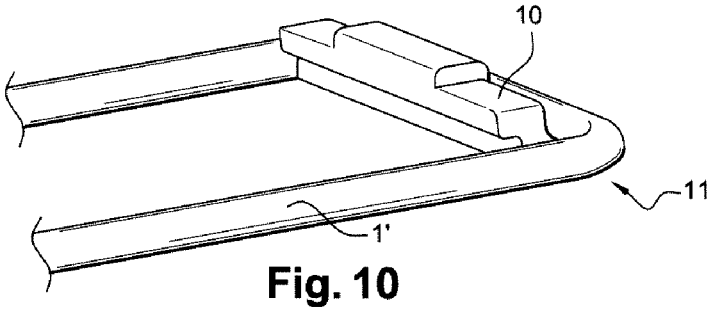
Figure 11:
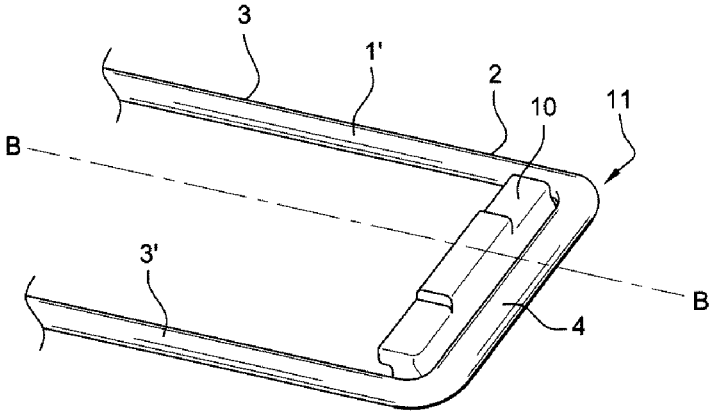
Figure 12:
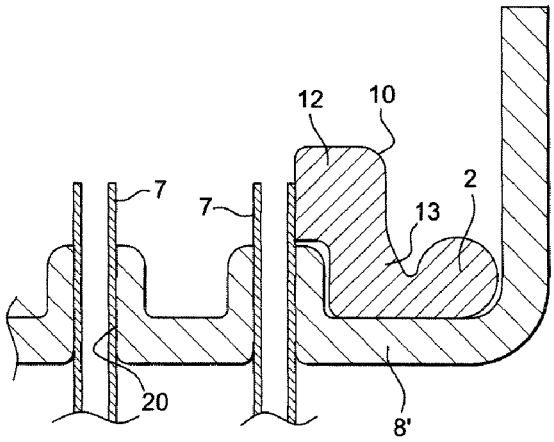
Figure 13:
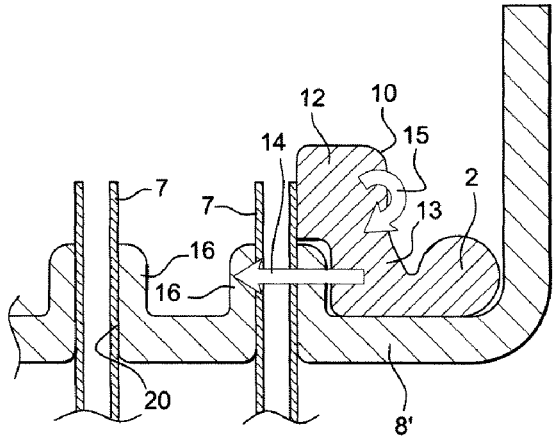

FIGS. 4 to 9 successively illustrate the steps in the method of automatically or manually fitting of the first embodiment of the sealing means depicted in perspective in FIG. 1;

FIG. 10 is a view of part of a second embodiment of a sealing means according to the invention;

FIG. 11 is a view of the second embodiment of the sealing means according to the invention, from a different angle;

FIG. 12 is a view in section on BB depicted in FIG. 11 of the second embodiment of the sealing means; and FIG. 13 is a view in section identical to the view in section of FIG. 12, which shows the forces and loads acting on the sealing means as a result of the tension therein.

Figure 2:
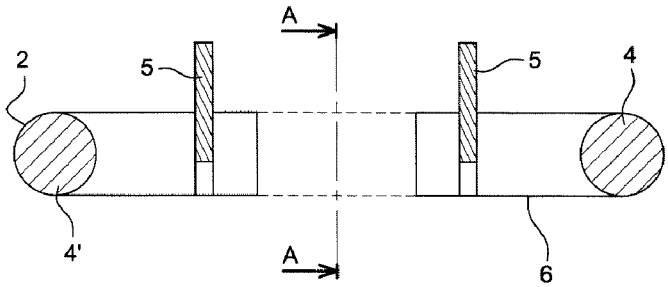
FIG. 2 is a section on BB depicted in FIG. 1, of the first embodiment of the sealing means.
Figure 3:
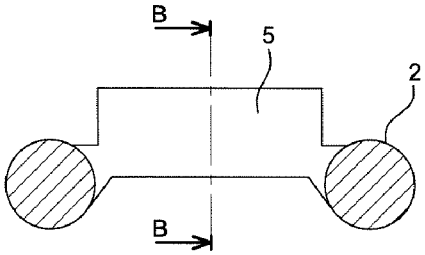
FIG. 3 is a section on AA depicted in FIG. 1 of the first embodiment of the sealing means.

FIG. 1 shows the sealing means 1 which in this instance consists of an elastic sealing gasket 1 having a periphery 2 of rectangular shape, with two long sides 3, 3' and two short sides 4, 4'. Moreover, this sealing gasket 1 comprises two transverse portions 5, that is to say that each of these portions 5 connects two opposite edges 3, 3' or 4, 4', here at right angles and between the two long sides 3, 3' of the periphery 2 of the sealing gasket 1. These perpendicular portions 5 moreover stand substantially perpendicular to the plane of extension of the sealing gasket 5, that is to say vertically with respect to the plane defined by the periphery of the sealing gasket 1. Moreover, as can be seen in FIGS. 2 and 3, these vertical portions 5 are slightly offset, that is to say that they stand up starting from above the lower level 6 of the sealing gasket 1.

The cross section of the sealing gasket 1, except in the region of the aforementioned portions 5, is a circular cross section whereas each of the portions 5 has a substantially rectangular cross section. The circular cross section of the sealing gasket 1 is particularly well suited to the use made of said gasket 1 (although it could of course have some other shape), but the rectangular cross section of the aforementioned portions 5 is, on the other hand, chosen by way of example and could perfectly well differ, for example could have a circular, oval or any other shaped cross section suited to being gripped by an automatic arm or by the hand of an operator.

Likewise, the thickness or width of each of the gripping portions 5 can be chosen at will so long as these portions 5 are robust enough that they can be handled and easily fitted between the ends of tubes 7.

FIGS. 4 to 9 illustrate the successive steps of the fitting of the sealing gasket 1 on the header plate 8. The sealing gasket 1 chosen to illustrate the method of fitting on the header plate 8 is identical to the one 1 shown in FIGS. 1 and 2. Here, this fitting is illustrated using a machine (not depicted in the attached figures), that is to say fitting performed automatically using two pairs of gripper jaws 9, 9' set in motion by a machine, not depicted in the attached figures. It will simply be noted that the sealing means 1 would be fitted in substantially the same way if the steps were performed by a (simple) operator.

Figure 4:
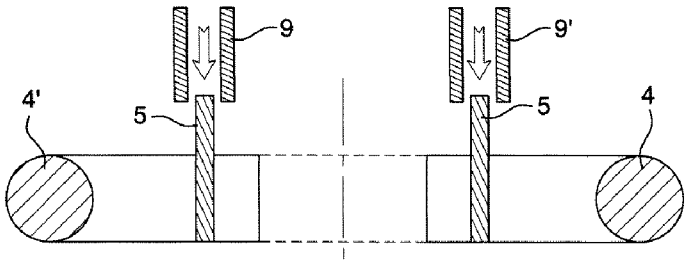

FIG. 4 depicts the two pairs of gripper jaws 9, 9' over the gripping portions 5 so that each of the pairs of gripper jaws 9, 9' can be lowered so that each flanks a gripping portion 5.

Figure 5:
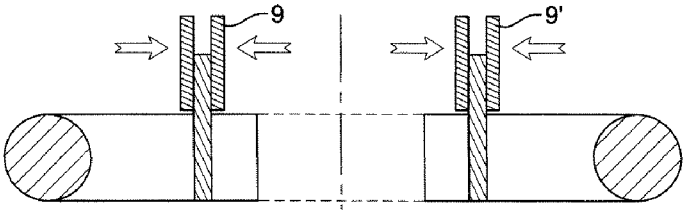

FIG. 5 depicts the clamping of each of the pairs of gripper jaws 9, 9' onto the respective corresponding gripping portion 5, so that the sealing gasket 1 can be handled.

Figure 6:
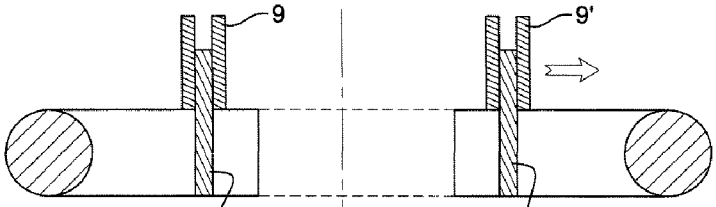

FIG. 6 has elected to illustrate the step of stretching the elastic sealing gasket 1 by moving the gripper jaw 9' located to the right in FIGS. 4 to 9. Of course, the elastic gasket 1 could have been stretched in a different way, for example by pulling on the gripping portion 5 situated to the left, or also by pulling simultaneously on both gripping portions 5. To perform the stretching, the pair(s) of gripper jaws 9 has/have to be moved in the direction away from the position of the other gripping portion 5. At this stage, the sealing gasket 1 is stretched, and therefore under (high) tension, which means that it has dimensions which are (very much) greater than the dimensions that it has at rest and that it can thus easily be positioned on the header plate 8.

Figure 7:
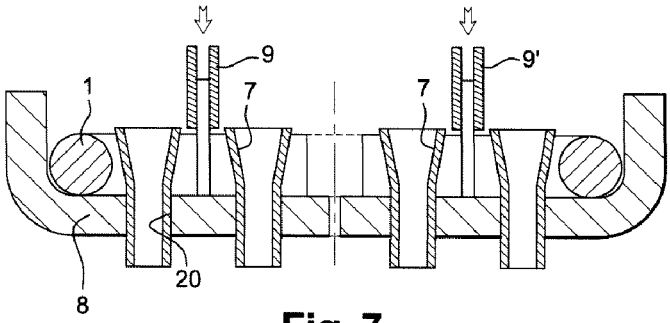

FIG. 7 illustrates, in cross section, the sealing gasket 1 under tension and positioned on a header plate 8. Said header plate has a series of orifices 20 which is arranged in a direction of extension of the plate, said orifices 20 allowing the passage of a plurality of tubes 7 or the like through which at least one fluid flows. Said orifices 20 for example have an oblong cross section with two long sides parallel to one another connected at each end by a semicircular shape appropriate to the cross section of the tubes used. Said orifices are arranged parallel one under the other, their long axis being positioned orthogonally to the direction of longitudinal extension of the plate. In the example illustrated, this is a header plate with no groove or channel.

The machine, using its pairs of gripper jaws 9, 9', has moved the sealing gasket 1 to be positioned over the header plate 8, then these pairs of gripper jaws 9, 9' have been lowered to set the gasket 1 down.

Figure 8:
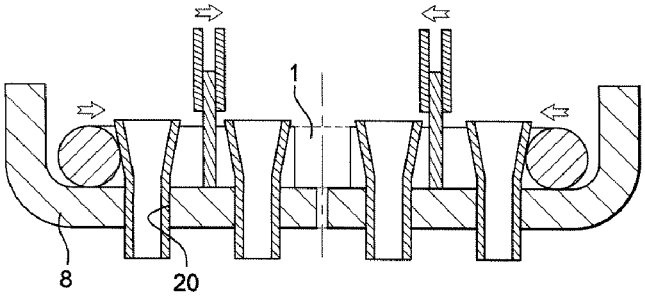

FIG. 8 depicts the step during which the two sets of gripper jaws 9, 9', or just one of the two sets 9, 9' if just one of the gripping portions 5 has been stretched, are brought back toward one another so that the tension in the elastic gasket 1 is reduced. It should be noted that while the tension in the gasket 1 is reduced during the step depicted in FIG. 8, this tension is not zero (or is even relatively high), which means that the sealing means 1 is always engaged under tension over at least two ends of tube 7, ideally the ends of tube 7 situated at the edge of the heat exchange core, not depicted in the attached figures.

Figure 9:
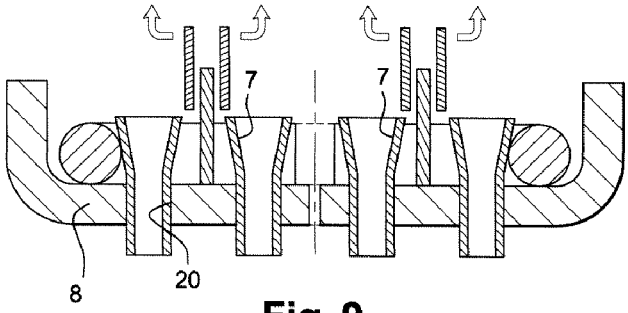

Next, as can be seen in FIG. 9, the two sets of gripper jaws 9, 9' are withdrawn, conventionally by raising these two pairs of gripper jaws 9, 9' or moving them upward so as to bring them out of engagement with the gripping means 5.

FIG. 9 shows the gripping means is located between but not in direct contact with adjacent tubes of the plurality of tubes.

FIGS. 10 to 13 illustrate a second embodiment of the subject matter of the invention.

This second sealing means 1' differs from that 1 depicted in FIGS. 1 to 9 essentially in relation to the gripping means 5, and to the shapes and positions thereof. The sealing gasket 1' as before has a shape suited to the circumference, or periphery, of the header plate 8', that is to say conventionally a rectangular shape, with two long sides 3, 3' and two short sides, substantially rounded at the four corners, as can be seen in the attached FIGS. 10 and 11.

Moreover, in this embodiment, the gripping means 10 are situated respectively at the two ends 11 of the sealing gasket 1', namely on the two opposing short sides 4, 4'.

It will be noted that the number of gripping means 5, 10, whether in the first or second embodiment, is of little importance which means that there could potentially be just one gripping means 5 or 10 or, on the other hand, more than two gripping means 5, 10, located at appropriate points along the sealing gasket 1, 1'. These gripping means 5, 10 may be produced from a material different than that used to form the sealing gasket 1, 1', or more specifically the periphery or perimeter 2 of the sealing gasket 1, 1', for example from another type of plastic which is stronger and less elastic than that of the periphery 2 of the sealing gasket 1, 1', for example by combining a polyamide for the gripping means 5, 10 with a latex rubber (with superior properties) for the periphery or circumference 2 of the sealing gasket 1, 1'.

In this context, it is important that the region formed between the gripping means 5 or 10 is an essentially elastic region of the sealing gasket 1, 1' so that the sealing gasket 1, 1' can easily be stretched by action on the gripping means 5 or 10.

The gripping means 10 in the second embodiment consist of an axial protrusion consisting of two parts, an upper first part 12 for contact with one or more ends of tube 7 and a set-back second part 13 that provides the connection between the periphery 2 of the sealing gasket 1' and the contact part 12. The second part 13 extends from the periphery 2 of the gasket 1' substantially at the same level or height as the periphery 2, while the first part 12 extends above the second part 13 and has an axial protruding part. Thus, the first part 12 is axially offset with respect to the second part 13 so that the second part 13 is said to be set back, with respect to the contact first part 12. Specifically, the axially protruding part of the first part 12 is that part of the sealing gasket 1' that comes into contact with the ends of tube 7.

This special structure of the gripping means 1' in the second embodiment has advantages in terms of the way in which the sealing gasket 1' behaves under tension. Because the sealing gasket 1' is set down, automatically or manually, in substantially the same way as in the first embodiment, when the sealing gasket 1' is fitted onto the header plate 8' and some of its tension is subsequently released, the sealing gasket 1' has a natural tendency to contract (elastic return force), as has been represented by the arrow 14. Now, because the first part 12 of the sealing means 1' is pressing against the end of a tube 7, a resultant force 15 will tend to press the set-back second part 13 firmly against the flange 16, thus avoiding any risk of twisting or warping of the sealing gasket 1'. Moreover, the sealing gasket 1', via its gripping means 12, will be perfectly firmly pressed against the end or ends of tubes 7 and against the flange 16 if present that protrudes from the header plate 8'.

The cover, not depicted in the attached figures, is fixed to the header plate 8, 8' in a way that is perfectly well known to and mastered by those skilled in the art, for example using teeth, not depicted in the attached figures, provided for this purpose on the header plate 8, 8' and that can be crimped onto the edges of the cover.

The invention claimed is:

1. A brazed heat exchanger comprising a heat exchange core comprising a plurality of tubes through which at least one fluid flows, the ends of which are respectively fixed by brazing to two header tanks, each of said header tanks comprising:

at least one header plate, having at least one series of orifices, which series is arranged in a direction of extension of said header plate, said at least one series of orifices being provided for the passage of said plurality of tubes;

at least one cover intended to close said header tank at least in part when fixed to said header plate; and an elastic sealing means situated between said header plate and said cover, wherein said elastic sealing means is arranged resting against and in tension on at least one part that emerges into said header tank of said plurality of tubes that pass through said at least one series of orifices located at the opposite ends of said at least one series of orifices, and wherein said elastic sealing means has a gripping means extending toward said at least one cover beyond said plurality of tubes for facilitating selective tensioning of said elastic sealing means, wherein the gripping means is located between but not in direct contact with adjacent tubes of the plurality of tubes.

2. The brazed heat exchanger as claimed in claim 1, wherein said header plate extends along a substantially planar surface so that said elastic sealing means is not positioned in a dedicated indentation or groove.

3. The brazed heat exchanger as claimed in claim 1, wherein a region situated between said gripping means constitutes an elastic region of said elastic sealing means, it being possible for the other regions of said elastic sealing means to be elastic or inelastic.

4. The brazed heat exchanger as claimed in claim 1, wherein said gripping means consists of at least two portions extending substantially perpendicular to the plane of extension of said elastic sealing means and connecting two opposite edges of said elastic sealing means.

5. The brazed heat exchanger as claimed in claim 1, wherein said header plate extends along a substantially planar surface so that said elastic sealing means is not positioned in a dedicated indentation or groove.

6. The brazed heat exchanger as claimed in claim 3, wherein said gripping means consist of at least two portions extending substantially perpendicular to the plane of extension of said elastic sealing means and connecting two opposite edges of said elastic sealing means.

7. The brazed heat exchanger as claimed in claim 3, wherein said elastic region is comprised of a first material and said gripping means is comprised of a second material with said first material having a higher elasticity than said second material for facilitating elongation of said elastic region while maintaining a configuration of said gripping means.

* * * * *